US005727720A

United States Patent [19]

Thatcher

[11] Patent Number: 5,727,720

[45] Date of Patent: Mar. 17, 1998

[54] MODULAR HIP-SUPPORTED PACK WITH BILATERAL ARTICULATION

[75] Inventor: Bryce Thatcher, Rexburg, Id.

[73] Assignee: Ultimate Direction, Inc., Rexburg, Id.

[21] Appl. No.: 695,303

[22] Filed: Aug. 9, 1996

[51] Int. Cl.[6] ..... A45F 3/14

[52] U.S. Cl. ..... 224/664; 224/582; 224/662

[58] Field of Search ..... 224/664, 662, 224/663, 582, 583, 262, 680

[56] References Cited

U.S. PATENT DOCUMENTS

| | | | |
|---|---|---|---|
| D. 134,542 | 12/1942 | Wax | 224/680 X |
| D. 360,295 | 7/1995 | Myatt . | |
| 1,797,097 | 3/1931 | May | 224/640 X |
| 4,029,243 | 6/1977 | Zerobnick et al. . | |
| 4,287,971 | 9/1981 | Doulet . | |
| 4,303,186 | 12/1981 | Ollinger, IV . | |
| 4,307,826 | 12/1981 | Stewart . | |
| 4,449,654 | 5/1984 | Cappis . | |
| 4,523,703 | 6/1985 | McKenna . | |
| 4,637,536 | 1/1987 | Wong . | |
| 4,793,534 | 12/1988 | Berry . | |
| 4,867,360 | 9/1989 | Howard . | |
| 4,982,844 | 1/1991 | Wise . | |
| 4,998,654 | 3/1991 | Bruzek et al. . | |
| 5,024,360 | 6/1991 | Rodriquez . | |
| 5,025,965 | 6/1991 | Smith . | |
| 5,064,108 | 11/1991 | Headley . | |
| 5,067,643 | 11/1991 | McKinney . | |
| 5,090,604 | 2/1992 | Howe . | |
| 5,152,443 | 10/1992 | Hagan . | |
| 5,181,638 | 1/1993 | McHale . | |
| 5,221,032 | 6/1993 | Bott et al. . | |
| 5,228,609 | 7/1993 | Gregory . | |
| 5,240,157 | 8/1993 | Selhost . | |
| 5,294,030 | 3/1994 | Jollivette . | |
| 5,341,974 | 8/1994 | Robinson et al. . | |
| 5,375,749 | 12/1994 | Oliva . | |
| 5,407,111 | 4/1995 | Lanouette et al. . | |
| 5,465,886 | 11/1995 | Scherer . | |
| 5,487,498 | 1/1996 | Gleason . | |
| 5,503,314 | 4/1996 | Fiscus . | |
| 5,522,528 | 6/1996 | Petricola . | |
| 5,603,441 | 2/1997 | Easter | 224/582 |

*Primary Examiner*—Renee S. Luebke
*Attorney, Agent, or Firm*—Thorpe, North & Western, LLP

[57] ABSTRACT

A hip-supported pack is comprising a front band of flexible material attached to a back band of flexible material by means of two laterally displaced buckles providing for articulation between the front band and the back band to allow the pack to conform to varying human anatomy. The load to be packed can be displaced in and on a number of interchangeable front and back bands with complementary buckle sections.

13 Claims, 3 Drawing Sheets

MODULAR HIP-SUPPORTED PACK WITH BILATERAL ARTICULATION

BACKGROUND OF THE INVENTION

This invention relates to a hip-supported pack for an athlete or other active person, particularly a pack which has modular front and back bands which articulate bilaterally to adjust to the torso of each individual athlete and to generally conform to the anatomy of the human torso.

It is generally known to provide a belt around the waist of an individual to support a load such as in a waist pack, or as means to support a more traditional backpack in conjunction with a shoulder harness. Such belts are traditionally not unlike belts used to support trousers, that being an elongate strap of uniform width with a front and centrally placed buckle. The load is normally attached to the rear of the belt. In this configuration, the front of the belt tugs in a rearward direction on the front of the strap creating an uncomfortable and unnecessary tension on the muscles of the lower abdomen. This condition is exacerbated by the location of the buckle, and is particularly irritating to athletes who require a range of motion involving in the abdominal muscles, such as, for example, climbers.

Another disadvantage of an annular belt is that it is not easily adaptable to each unique individual torso, except with regard to girth generally. A person may have exaggerated or minimal protrusions at the stomach or buttocks. Attempts to change, or make adjustable, the width and length of an annular belt have not been successful in addressing such variances in human anatomy.

More elaborate schemes have been devised to address these disadvantages of torso-supported packs. For example adding a breast strap as in U.S. Pat. No. 4,307,826; and elaborately contouring the belt as in U.S. Pat. No. 5,025,965.

The conventional approaches all have failed to address the need for a hip-supported pack that will readily conform to the various anatomical shapes of individual athletes without presenting a buckle at and tension on the abdomen. Thus, there is a need in the art for a hip-supported pack with front and back bands that cooperate to articulate at lateral points to adjust to individual anatomy, thus also providing means for modular construction between front and back sections and for laterally displaced buckles.

SUMMARY OF THE INVENTION

It is an object of the invention to provide a hip-supported pack with lateral means for articulation between front and back sections.

It is a further object of the invention to provide such a hip-supported pack with lateral buckle and adjustment means which do not obstruct and irritate abdominal muscles.

It is also an object of the invention to provide such a hip-supported pack with a front section which does not exert pressure on the lower abdominal muscles in normal use.

It is another object of the invention to provide such a hip-supported pack which has readily interchangeable front and back sections.

The above and other objects of the invention are realized in a specific illustrative embodiment of a hip-supported pack with front and back modular bands, both of flexible material. The back band has a compartment or other means for supporting the load to be packed by the athlete. The word "compartment" is used broadly herein to mean both an enclosure and any of a broad class of concepts for attaching, or securing a load to be transported. The front band of flexible material may have one or more compartments for the same purpose. The back band is of a greater width for supporting a greater load over the hips and buttocks. The bands are attached at or near the ends by narrow straps. The narrow straps allow the front and back bands to pivot in respect to each other to provide flexibility in pack fit for each individual athlete. The straps also provide a place to locate buckles or other means of attachment and girth adjustment which do not obstruct or irritate of the area of the abdominal muscles of the athlete.

When a buckle is located on each strap, a means is provided to readily and fully detach the front band from the back band. This allows a front band of any of a number of configurations to be attached to a variety of back band configurations, thus, providing flexibility in potential athletic applications by an athlete.

The front section can be made in a "V" shape to further avoid obstruction of the abdominal muscles and thus complement the various axes of articulation of human anatomy.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION OF THE DRAWINGS

Figure 1:
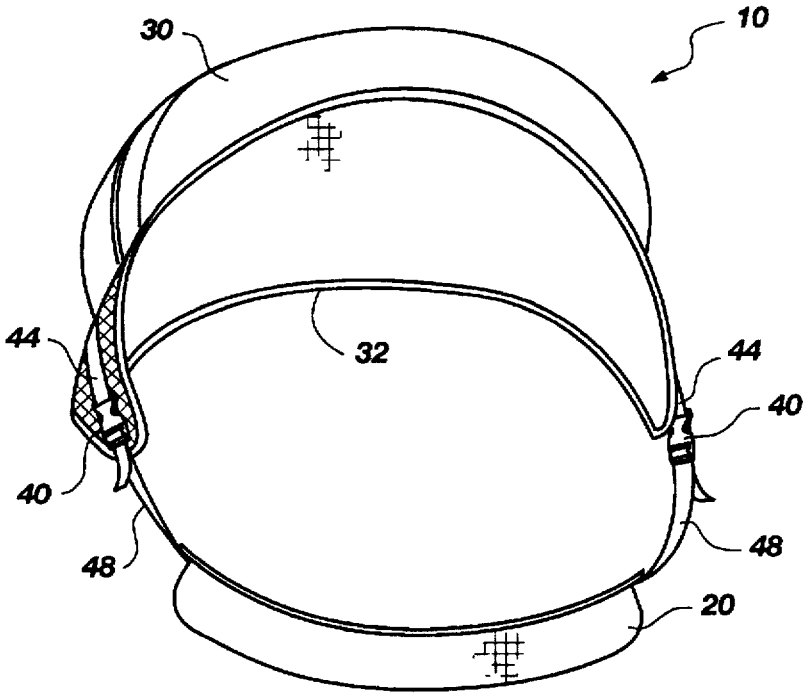
FIG. 1 is a perspective view of a hip-supported pack comprising an attached front and back band, made in accordance with the principles of the present invention.

Referring to FIGS. 1, 2, 3 and 4, there is shown generally at 10 a hip-supported pack with a front band 20 of flexible material and a back band 30 of flexible material.

The front band 20 and the back band 30 are connectible by means of lateral buckles generally depicted at 40. A first mating section 42 of each buckle 40 is attached to the back band 30 by means of straps 44 sewn to the back band, which straps 44 loop through the first mating section of each buckle, thus affixing thereto. A second mating section 46 of each buckle 40 is attached to the front band 20 by means of straps 48 sewn to the front band, which straps 48 loop through the second mating section to adjustably attach thereto. Tails 48' of the straps 48, serve as grasping means for pulling more of the strap through the second mating sections 46 to readily and symmetrically diminish the total girth of the pack. The girth of the pack can be increased by releasing more of each of the tails 48' back to the straps proper 48.

Figure 5:
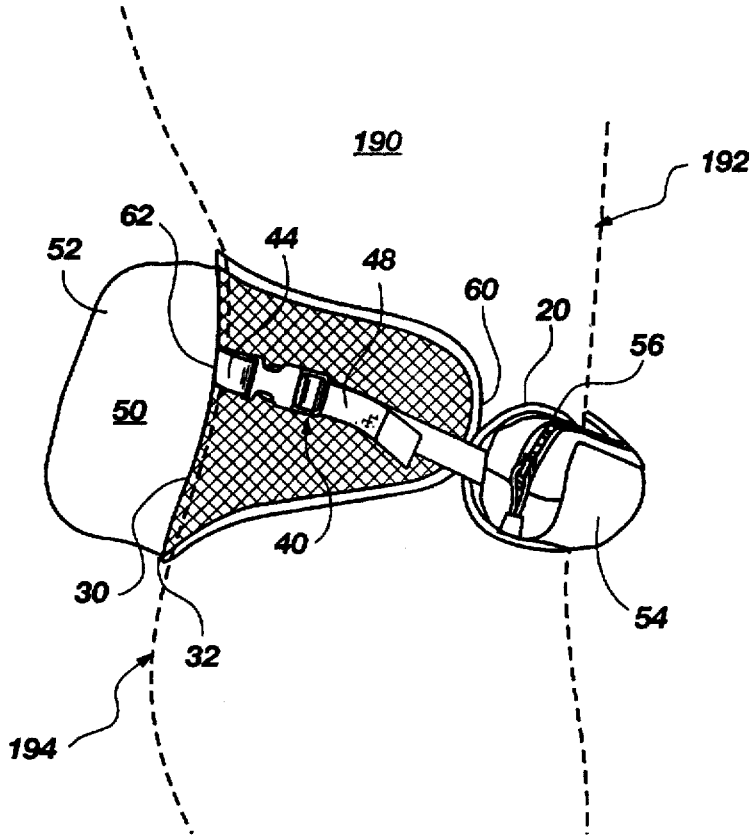
FIG. 5 is a perspective view of the hip-supported pack of FIG. 1 positioned as worn on the torso of an athlete.

The front strap 20 can be partially released from the back strap 30 by releasing one first buckle section 46 from one second buckle section 48, thus allowing the pack 10 to be removed from an athlete (FIG. 5). The front strap 20 can be fully detached from the back strap 30 by releasing both first buckle sections 46 from both second buckle sections 48. The benefits of full detachment will be described later herein.

The strap/buckle configuration described has the advantage of forming two lateral points of articulation between the front and back bands, 20 and 30 respectively. This allows for a great deal of flexibility in the geometry of the pack, while maintaining the breadth in one or more of the bands to allow a load to be distributed over a wide area. for example, if a person's hips are relatively wide compared to his or her waist, the back band 30 is free to flare out at the base, or lower end 32. On the other hand, if a person's waist is relatively wide, the pack will hang more vertical top-to-bottom.

This is more fully depicted in FIG. 5 where the hip-pack of FIG. 1, like numbered, is positioned on the torso of an athlete. The torso 190 is depicted in phantom lines with the lower abdominal muscle region generally at 192 and the buttocks generally at 194.

These features also allow the pack to hang lower in the weight bearing portions; primarily in the back, but in the front as well, as will later be described. Because of the lateral displacement of buckles 40, and straps 44 and 48, the pack 10 can curve up over the hips laterally, and down in the front and back. As was already explained, this allows the pack to follow the natural and variable contours of the human torso. It also allows the pack to conform with the articulation of the legs and avoid obstruction of the muscles of the lower abdomen (192, FIG. 5).

Means for carrying a load are disposed on the pack. A pouch 50 is disposed on the back band 30. The pouch 50 has a zipper 52 for securing items to be carried within the pouch. It will be appreciated that any number of configurations could be used, such a loops for tools, rigid attachment of a backpack, straps or bands for wrapping around a load, etc. (not depicted).

It may also be desirable to affix a load to the front band 20 in a similar manner. The front band 20 has pouch 54 formed therein. The pouch 54 also has a zipper enclosure 56 for securing items therein. A load on the front band 20 counterbalances a load on the back band 30, and encourages the front band to hang lower, thus not obstructing the lower abdominal muscles (192, FIG. 5) of the athlete.

Figure 4:
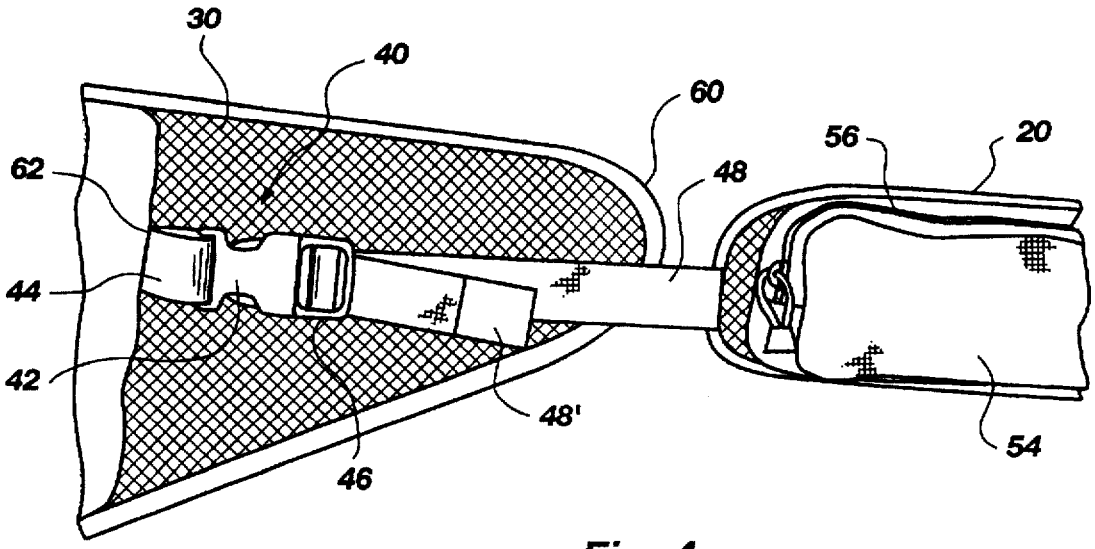
FIG. 4 is a partially cut away perspective view of the buckle detail of the left lateral buckle of the hip-supported pack of FIG. 1.

FIG. 4 depicts in detail the lateral arrangement of the inventive pack 10, of FIGS. 1–4 as previously described. It also depicts detail wherein the back band 30 comprises padded ends 60, which are displaced a distance from a point of attachment 62 of straps 44. Strap 44 is shorter than the distance from the attachment point 62 to the end 60. The buckle 40 arrangement is separated from the athlete by the padded end, thus preventing the buckle from abrading against the lateral torso of the athlete.

Figure 3:
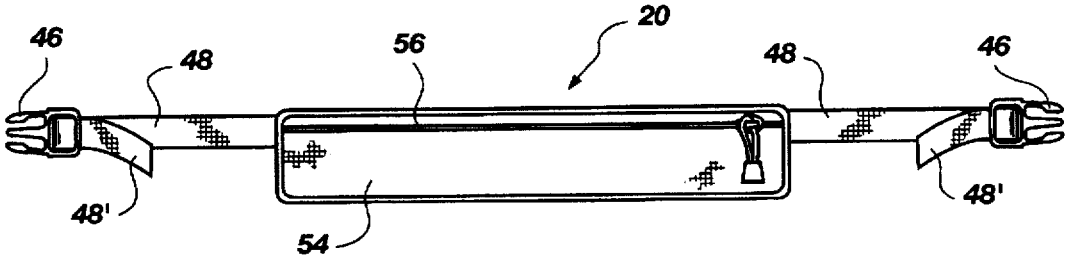
FIG. 3 is a plan view of the fully detached modular front band of FIG. 1.
Figure 3A:
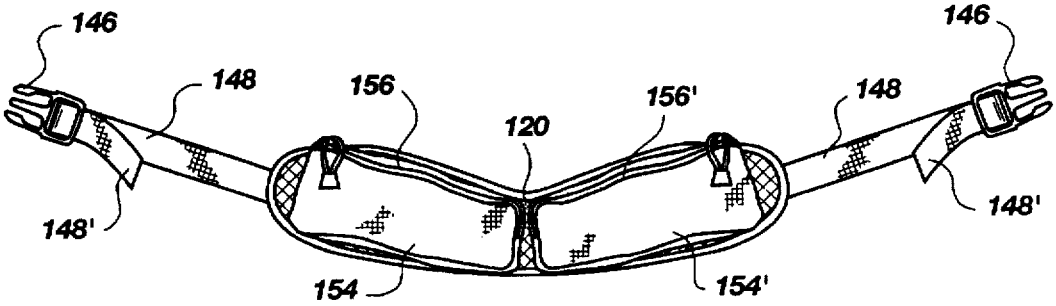
FIG. 3*a* is a plan view of a fully detached modular front band of a second preferred embodiment.

In a second preferred embodiment, FIG. 3*a*, in which like numbers (plus 100) depict like structure to that already described, the front band 120 is "V" shaped. This naturally encourages the center of the front band 120 to a position below the lower abdominal muscles (192, FIG. 5) of the athlete. No buckle is placed in this region in the inventive pack.

The articulation of the legs and torso of an athlete are not complemented by an annular waist circumscribing belt. The legs have planes of articulation passing through the right and left iliac crests, the hip joints and the crotch. This is the contour more generally followed by the described configuration. Because the pack more generally follows the lines of articulation involved in athletic activity, it is less inclined to abrade or otherwise irritate the athlete during strenuous and repetitive activity. It also avoids pressure, and the consequent fatigue, on and of the lower abdominal muscles (192, FIG. 5).

Figure 2:
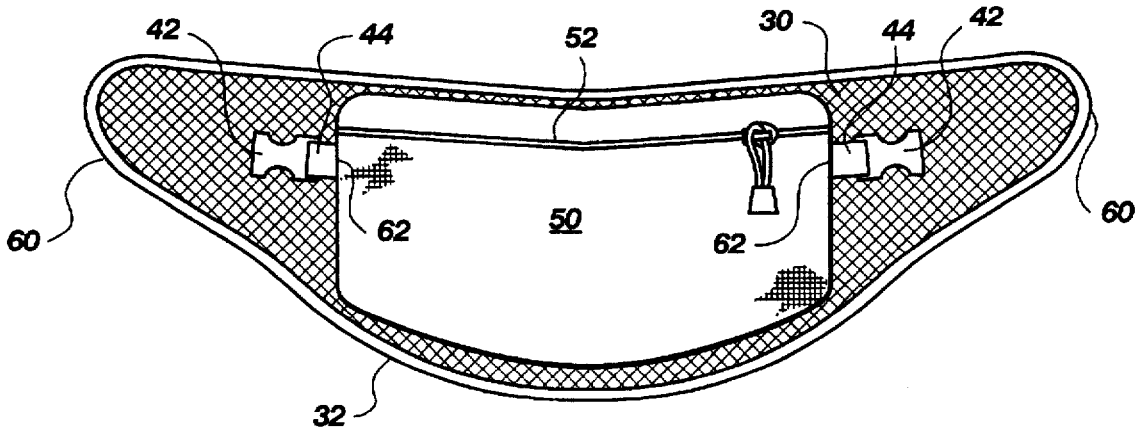
FIG. 2 is a plan view of the fully detached modular back band of FIG. 1.
Figure 2A:
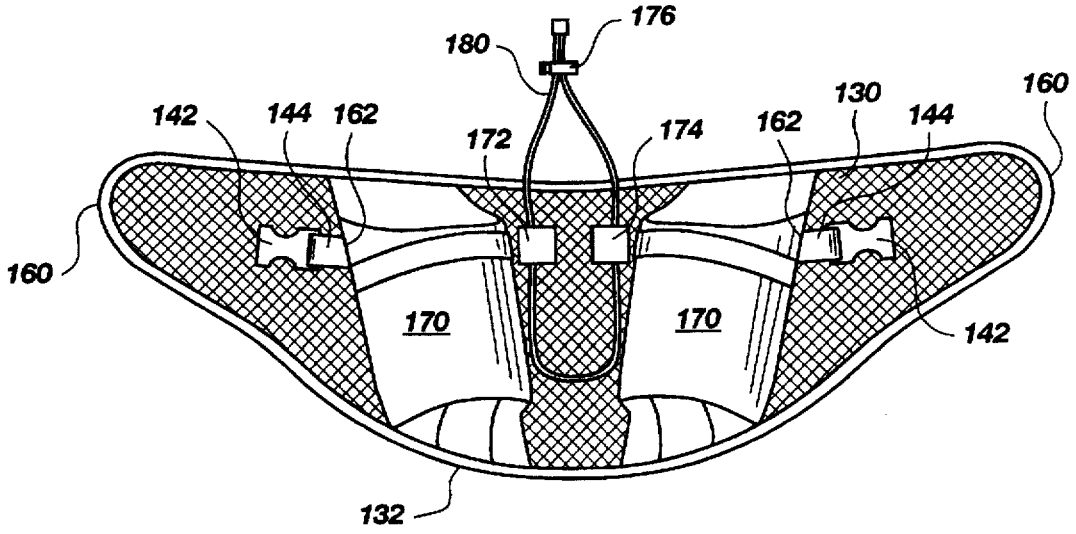
FIG. 2A is a plan view of a fully detached modular back band of a second preferred embodiment.

In a second preferred embodiment of the back band, FIG. 2*a*, in which like numbers (plus 100) depict like structure to that already described, the back band 130 is configured to support beverage containers (not depicted) in cup-shaped compartments 170. This allows for carrying a load of fluid for hydration of the athlete during extreme athletic activity. The back band 130 is also outfitted with a draw string 180 looped through two keepers 172 and 174 sewn centrally onto the back band 130. The draw string 180 forms a continuous loop for securing a variety of loads to the pack. A moveable clamp 176 is provided to increase, decrease and secure the effective circumference of the load securing loop formed in the draw string.

Buckle sections 42, 46, 142 and 146 are all of complementary configuration and interchangeable. The front band 20 of FIG. 3 can be readily secured to the back band 30 of FIG. 3*a*, and so on. It will also be appreciated that there are a substantial number of inventive pack configurations that could be made available through such modularity embodying the principles of the present invention.

The embodiments of the invention described herein are only examples of how the invention may be applied to specific devices. Modifications and variations of, for example, materials used, sizes and shapes of components, and equivalent structures will be apparent to those skilled in the art while remaining within the scope of the invention.

What is claimed is:

1. A hip-supported pack comprising a front band of flexible material, a back band of flexible material with at least one compartment disposed thereon, first releasable fastener means to attach the front band to the back band at a lateral position, and second releasable fastener means to attach the front band to the back band at a lateral position substantially opposite the first fastener means such that the front and back bands combine to form a torso circumscribing belt.

2. The pack of claim 1, wherein the belt has a circumferential size, and wherein at least one of the releasable fastener means further comprises means for adjusting the circumferential size of the belt.

3. The pack of claim 1 wherein the front band is "V" shaped.

4. The pack of claim 1 wherein the back band further comprises first and second padded ends, the first releasable fastener means attached to an external surface of the back band a distance from the first end and the second releasable fastener means attached to an external surface of the back band a distance from the second end such that the first and second padded ends buffer a user from the first and second fastener means.

5. A pack as in claim 1 wherein the first fastener means and the second fastener means comprise buckles.

6. The pack of claim 1 wherein the front band further comprises at least one compartment.

7. A pack as in claim 6 wherein the at least one back band compartment is configured to carry beverage containers.

8. A pack as in claim 7 wherein the at least one front band compartment is configured for carrying food.

9. A hip-supported pack comprising a front band of flexible material, a back band of flexible material with means for attaching a load thereto, first lateral means for pivotally attaching the front band to the back band and second lateral means for pivotally attaching the front band to the back band substantially opposite the first lateral means, the first and second lateral means comprising elongate woven straps sewn at one end to the front band and sewn at the other end to the back band, and fastener means to releasably fasten the pack about an athlete's torso.

10. The pack of claim 9 wherein the back band further comprises first and second padded ends, the first lateral means attached to an external surface of the back band a distance from and in frictional contact with the first end and the second lateral means attached to an external surface of the back band a distance from and in frictional contact with the second end such that the first and second padded ends buffer the athlete from the lateral means and restrain pivoting of the pack.

11. A pack as in claim 10 wherein front band is "V" shaped.

12. A pack as in claim 11 further comprising a buckle for fastening the pack to an athlete's torso and adjustment means for changing the circumferential size of the pack.

13. A pack as in claim 11 further comprising at least one laterally disposed buckle for releasably fastening the pack to an athlete's torso and laterally disposed adjustment means for changing the circumferential size of the pack.

* * * * *